252-102 AU 165 EX
9/27/77 XR 4,051,056

United States Patent [19]
Hartman

[11] 4,051,056
[45] * Sept. 27, 1977

[54] ABRASIVE SCOURING COMPOSITIONS

[75] Inventor: William Law Hartman, Cheviot, Ohio

[73] Assignee: The Procter & Gamble Company, Cincinnati, Ohio

[ * ] Notice: The portion of the term of this patent subsequent to Oct. 12, 1993, has been disclaimed.

[21] Appl. No.: 610,220

[22] Filed: Sept. 4, 1975

Related U.S. Application Data

[63] Continuation-in-part of Ser. No. 504,217, Sept. 9, 1974, abandoned.

[51] Int. Cl.[2] ..... C11D 7/56
[52] U.S. Cl. ..... 252/99; 252/95; 252/102; 252/160
[58] Field of Search ..... 252/99, 94, 160, 102, 252/95

[56] References Cited

U.S. PATENT DOCUMENTS

| | | | |
|---|---|---|---|
| 2,489,848 | 11/1949 | Bacon | 252/539 |
| 2,734,812 | 2/1956 | Robie | 252/99 |
| 3,042,622 | 7/1962 | Kirschenbauer | 252/99 |
| 3,281,367 | 10/1966 | Jones et al. | 252/112 |
| 3,446,893 | 5/1969 | Hanford et al. | 426/76 |
| 3,458,446 | 7/1969 | Diaz | 252/99 |
| 3,519,569 | 7/1970 | Diaz | 252/99 |
| 3,530,071 | 9/1970 | Moore | 252/99 |
| 3,558,496 | 1/1971 | Zmoda | 252/95 |
| 3,560,389 | 2/1971 | Hunting | 252/95 |
| 3,623,990 | 11/1971 | Cambre | 252/DIG. 14 |
| 3,630,922 | 12/1971 | McClain | 252/99 |
| 3,650,956 | 3/1972 | Strand | 252/90 |
| 3,702,826 | 11/1972 | Kocelch et al. | 252/99 |
| 3,715,314 | 2/1973 | Morgenstern | 252/99 |
| 3,716,488 | 2/1973 | Kolsky et al. | 252/155 |
| 3,843,548 | 10/1974 | James | 252/187 |
| 3,884,826 | 5/1925 | Phares et al. | 252/89 |

FOREIGN PATENT DOCUMENTS

| | | |
|---|---|---|
| 47,282 | 11/1972 | Japan |
| 23,806 | 3/1973 | Japan |
| 10,558 | 1967 | Japan |
| 646,765 | 0000 | United Kingdom |
| 711,356 | 0000 | United Kingdom |

OTHER PUBLICATIONS

Modern Plastics, "Glass Microballoon Particles, a Low Density Filler" 11-71, Alford et al.
Technical Data Sheet (Perlite) No. 2-1 1971, Perlite Institute Inc.
Eccospheres Technical Bulletin, 1972.

*Primary Examiner*—Mayer Weinblatt
*Attorney, Agent, or Firm*—Ronald L. Hemingway; Douglas C. Mohl; Richard C. Witte

[57] ABSTRACT

Abrasive, hard surface cleanser compositions containing a surfactant, a particular type of expanded perlite material and a filler material which can be inorganic salt, water or mixtures thereof. Such compositions, whether liquid or granular, provide excellent stain and soil removal from hard surfaces but leave very little or no residual abrasive grit after being rinsed from such surfaces.

8 Claims, No Drawings

ABRASIVE SCOURING COMPOSITIONS

CROSS-REFERENCE TO RELATED APPLICATIONS

This application is a continuation-in-part of application Ser. No. 504,217, filed Sept. 9, 1974, now abandoned.

BACKGROUND OF THE INVENTION

The instant invention relates to abrasive scouring cleaners which can be either liquid or granular in form. Such cleansers utilize a very particular type of expanded perlite abrasive in order to realize especially beneficial performance characteristics.

Abrasive scouring cleansers provide a convenient and useful means for carrying out ordinary household cleaning of hard surfaces. The particulate abrasive material within such compositions serves to abrade and loosen soil adhering to hard surfaces and further serves to create more intimate contact between hard surface stain and the surfactant and/or bleaching agents also present in the cleansing compositions.

Abrasive cleansers have traditionally contained water-insoluble, relatively hard, particulate mineral material as the abrasive agent. The most common such abrasive agent is finely divided silica sand having particle size varying between about 1 and 300 microns and specific gravity of about 2.1 or higher. While such material is generally very effective in scouring soil and stains from the surfaces being treated, abrasive material of this type tends to be difficult to rinse away from the hard surface once scouring is completed. Thus, even after rinsing, a palpable, unsightly gritty residue is frequently left behind which is especially noticeable on dark or colored surfaces.

Residual grit can, of course, be reduced by lowering the amount of abrasive material within the scouring composition or by reducing the particle size and/or density of such abrasive material. Concentration, size and density reduction generally tends, however, to decrease the effectiveness of the abrasive composition in removing soil and stain. There is thus a continuing need for effective, low residue producing, abrasive scouring cleansers.

Accordingly, it is an object of the present invention to provide abrasive scouring compositions which are highly effective for removing soil and stain from hard surfaces.

It is a further object of the present invention to provide abrasive scouring compositions which leave minimal gritty abrasive residue after such compositions are rinsed from the surface being cleaned.

It is a further object of the present invention to provide highly effective, low residue, abrasive scouring compositions which are physically and chemically stable whether in liquid or granular form.

It has been discovered that abrasive compositions of this desired type can be realized by utilizing a particular type of expanded perlite abrasive in combination with surfactant, filler material and other optional scouring cleanser ingredients. Although perlite materials are known abrasive materials and have been utilized in grinding wheels and some soap, hand cleaning, concrete cleaning and polishing compositions [See, for example, Robie, U.S. Pat. No. 2,734,812, issued Feb. 12, 1956; Bandau, German Pat. Nos. 1,233,078 and 1,256,343, published respectively Jan. 26, 1967 and Dec. 14, 1967; Ekoperal, German Pat. No. 1,289,600, published Feb. 20, 1969; Meisei, Japanese Patent Application 10558/67, published Nov. 29, 1972, Publication No. 72/47282; and Iwaguma et al, Japanese Pat. Application 71/57,404. published March 28, 1973, Publication No. 80/23,806], it has not been heretofore appreciated that expanded perlite of particular size and density can be used in particular concentrations within the context of household scouring cleansers to provide unexpectedly beneficial scouring and rinsability performance results. It has been discovered that by utilizing such particular perlite materials in combination with surfactant and filler materials, the above objectives can be realized and household scouring cleansers formulated which are surprisingly superior to those found in the prior art.

SUMMARY OF THE INVENTION

The abrasive hard surface cleanser compositions of the present invention comprise from about 0.1% to 15% by weight of a surfactant and from about 1% to 65% by weight of an expanded perlite abrasive material, the balance of the composition being a filler material and possibly other optional ingredients.

The surfactant component can be any conventional anionic, nonionic, ampholytic or zwitterionic surface active agent.

The expanded perlite abrasive material has particle size which varies from about 1 to 190 microns and an average specific gravity which varies between 0.2 and 2.2.

The filler material can be inorganic salt or salts, water or mixtures of inorganic salt(s) and water. The inorganic salt can perform the additional function of acting as buffering agent, detergency builder or both.

Preferred concentrations of the essential components as well as the type, number and concentration of other optional composition ingredients are determined by whether liquid or granular abrasive scouring cleansers are desired.

DETAILED DESCRIPTION OF THE INVENTION

The abrasive, hard surface cleansing compositions of the instant invention can be either in liquid or granular form. For purposes of the instant invention, a "liquid" composition is any formulation which is fluid in nature. Thus, liquid compositions can be of low viscosity and free-flowing or can be thickened, thixotropic, false-bodied, plastic or paste-like in nature. Whether liquid or granular, however, the instant compositions essentially contain surfactant, perlite abrasive and a filler material.

If the composition is liquid, the filler component is either free water or a mixture of water and inorganic alkaline salt. These liquid systems can optionally contain such materials as bleaching agents, suspending agents, additional conventional abrasive materials, additional builder or buffer salts, dyes and perfumes.

If the composition is granular, the essential filler is inorganic alkaline salt(s) or mixtures of inorganic salt(s) and moisture. These granular systems can optionally contain such materials as bleaching agents, bleach stabilizers, additional conventional abrasive materials, additional builder or buffer salts, performance enhancing adjuvants including bleach catalysts, dyes and perfumes.

Each of these components, both essential and optional, as well as composition preparation and use are discussed in greater detail as follows:

SURFACTANT

The instant cleaning compositions contain from about 0.1% to 15% by weight of a surfactant selected from the group consisting of anionic, nonionic, ampholytic and zwitterionic surface active agents. For liquid systems, surfactant is preferably present to the extent of from about 0.1% to 7% by weight of the composition. For granular systems, surfactant is preferably present to the extent of from about 1.5% to 10% by weight of the composition.

Anionic detergents can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium $\beta$-acetoxy- or $\beta$-acetamido-alkanesulfonates where the alkane has from 8 to 22 carbon atoms.

Nonionic surface active agents operable in the instant compositions can be of three basic types — the alkylene oxide condensates, the amides and the semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble-compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Hass Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surface active agent include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process.

Examples of the semi-polar type of nonionic surface active agents are the amine oxides, phosphine oxides and sulfoxides. These materials are described more fully in Berry, U.S. Pat. No. 3,819,528, issued June 25, 1974, incorporated herein by reference.

Ampholytic synthetic detergents can be broadly described as derivatives of aliphatic amines which contain a long chain of about 8 to 18 carbon atoms and an anionic water-solubilizing group, e.g. carboxy, sulfo or sulfato. Examples of compounds falling within this definition are sodium 3-dodecylamino-propionate, sodium -3-dodecylamino propane sulfonate, and dodecyl dimelthylammonium hexanoate.

Zwitterionic surface active agents operable in the instant composition are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

For liquid compositions of the instant invention, it is especially desirable to utilize surfactants which are exceptionally stable against chemical decomposition and oxidation by the strong active chlorine or active oxygen bleaching agents which are optionally present. Such preferred bleach stable surfactant materials contain no functionalities (such as ether linkages, unsaturation, some aromatic structures, or hydroxyl groups) which are susceptible to oxidation by hypochlorite or peroxygen bleaching species.

Bleach-stable surfactants which are especially resistant to oxidation fall into two main groups. One such class of bleach-stable surfactants is the water-soluble alkyl sulfates containing from about 8 to 18 carbon atoms in the alkyl group. Alkyl sulfates are the water-soluble salts of sulfated fatty alcohols. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials preferred for use in liquid systems of the instant invention are the water soluble betaine surfactants. These materials have the general formula:

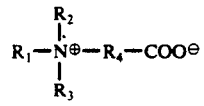

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate bentaines decompose in aqueous solution and are hence preferably not included in the instant liquid compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropyl ammonium pentanoate. Especially preferred betaine surfactants include dodecyldimethylammonium acetate, dedecydimethylammonium hexanoate, hexadecyldimethylammonium acetate, and hexadecyldimethylammonium hexanoate.

For granular compositions of the present invention, and even for granular systems containing an optional chlorine bleaching agent, the preferred surfactant materials are 1) the water-soluble alkyl ether sulfates containing from about 10 to 20 carbon atoms in the alkyl moiety and from about 1 to 10 moles of ethylene oxide per mole of surfactant and 2) the water-soluble alkyl benzene sulfonates wherein the alkyl moiety contains from about 9 to about 14 carbon atoms.

Suitable alkyl ether sulfates include the alkali metal (lithium, sodium and potassium) and alkanolamine salts of ethoxylated, sulfated fatty alcohols. Fatty alcohol precursors of these surfactants include the same materials enumerated above in discussion of the preferred alkyl sulfate surfactants for use in liquid systems. Highly preferred alkyl ether sulfates are the sodium and potassium alkyl ether sulfates which contain from about 12 to 18 carbon atoms in the alkyl group (i.e., tallow alcohol derivatives) and which contain an average of from about 2.0 to 3.5 moles of ethylene oxide per mole of surfactant.

Suitable alkylbenzene sulfonates include the alkali metal (lithium, sodium, potassium) and alkanolamine salts of straight- or branched-chain alkylbenzene sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetradecyl benzene sulfonic acid and tetrapropylene benzene sulfonic acid. Preferred sulfonic acids as precursors of the alkylbenzene sulfonates useful for granular compositions herein are those in which the alkyl chain is linear and averages about 12 carbon atoms in length. Examples of commercially available alkyl benzene sulfonic acids useful in the present invention include Conoco SA 515, SA 597, and SA 697 all marketed by the Continental Oil Company and Calsoft LAS 99 marketed by the Pilot Chemical Company.

EXPANDED PERLITE ABRASIVE

A second essential component of the instant hard surface cleansing compositions is an expanded perlite abrasive material. Perlite itself is a naturally-occurring siliceous volcanic mineral. A typical chemical analysis of perlite is shown as follows:

| Typical Perlite Analysis | | |
|---|---|---|
| Silicon dioxide | ($SiO_2$) | 71-75% |
| Aluminum oxide | ($Al_2O_3$) | 12.5-18.0% |
| Potassium oxide | ($K_2O$) | 4.0-5.0% |
| Sodium oxide | ($Na_2O$) | 2.9-4.0% |
| Calcium oxide | (CaO) | 0.5-2.0% |
| Ferric oxide | ($Fe_2O_3$) | 0.5-1.5% |
| Magnesium oxide | (MgO) | 0.1-0.5% |
| Titanium dioxide | ($TiO_2$) | 0.03-0.2% |
| Manganese dioxide | ($MnO_2$) | 0.03-0.1% |
| Sulfur trioxide | ($SO_3$) | 0-0.2% |
| Ferrous oxide | (FeO) | 0-0.1% |
| Chromium | (Cr) | 0-0.1% |
| Barium | (Ba) | 0-0.05% |
| Lead Oxide | (PbO) | 0-0.03% |
| Nickel oxide | (NiO) | Trace |
| Copper | (Cu) | Trace |
| Boron | (B) | Trace |
| Beryllium | (Be) | Trace |
| Molybdenum | (Mo) | Trace |
| Arsenic | ($As_2O_3$) | <0.1 ppm |
| Free silica | | 0-2% |

The perlite useful as the abrasive material herein is expanded perlite. Expansion of perlite is accomplished by heating the raw material to a point within its softening range of from 1600° F - 2000° F in order to expand the mineral to the extent of from four to twenty times its original volume. During the expansion process, bubbles of water vapor are trapped within the molten perlite. Upon cooling, some of these bubbles are retained within the expanded perlite particles. Perlite expansion methods are described more fully in Howle; U.S. Pat. 2,572,483; issued Oct. 23, 1951 and Maxey; U.S. Pat. 2,935,267; issued May 3, 1960; both patents being incorporated herein by reference.

The presence of water vapor bubbles account for the relatively low density of the perlite abrasive material and especially of that perlite material which has not been crushed after expansion. Such bubbles also help, especially after crushing of the expanded perlite, to form the irregular, multi-faceted, flake-like particles of perlite abrasive material. Without being bound by any particular theory, it is believed that the unexpectedly desirable scouring and rinsability properties of the particular expanded perlite abrasive specified for use in the instant compositions are attributable in part to this increased number of sharp, highly angular edges per unit weight of expanded perlite compared to the same weight of more conventional abrasive material such as silica flour, pumice or calcium carbonate. Improved rinsability of the expanded perlite abrasive is also believed to be due in part to the relatively light density of this material.

For liquid embodiments of the present invention, the expanded perlite abrasive contributes to composition phase stability. The relatively low density expanded perlite, and especially expanded perlite having specific gravity less than 1.0, is more easily dispersed and suspended throughout the liquid compositions than are conventional abrasive materials. Furthermore, there is less tendency for the expanded perlite abrasive to cause phase separation and clear layer formation in preferred liquid compositions of the present invention which are false-bodied or thixotropic in form.

It is essential that the expanded perlite abrasive used in the present invention fall within specified particle size and density limitations and be present in particular amounts within the instant compositions. Maintenance of these parameters within particular ranges helps insure that the compositions of the present invention provide unexpectedly desirable scouring and rinsability performance.

The size of substantially all of the expanded perlite particles used in the instant compositions must fall within the range of from about 1 micron to 190 microns, preferably from about 20 microns to 110 microns. In terms of conventional screen analysis, such limitation means that a relatively small portion of the abrasive batch, i.e., less than about 5% is retained on a 65 mesh screen and a relatively small portion of the abrasive batch, i.e., less than about 5% appears as dust of less than 1 micron in diameter. Of course, the average particle size of the abrasive batch will fall within the micron ranges specified.

Particle density of the expanded perlite abrasive material useful herein is described in terms of average specific gravity. "Specific gravity" for purposes of the instant invention has its conventional definition, i.e., the weight of abrasive material per cubic centimeter of water displaced by such material. Average specific gravity of the expanded perlite abrasive of the present invention ranges from about 0.2 to 2.2, preferably from about 0.5 to 0.99 for liquid systems.

Examples of commercially-available expanded perlite abrasives suitable for use in the instant compositions are those materials having the trade name TERRA-FIL, marketed by the Johns-Manville Products Corporation, and those having the trade names "40-1" and "Superfines" marketed by Silbrico Corporation.

Grades 40-1 and Superfines marketed by Silbrico Corporation have average specific gravity at the lower end of the range specified above and hence are particularly useful in liquid compositions of the present invention. Superfines, for example, is a highly preferred material of this type. This particular expanded perlite has an average specific gravity of about 0.7 and a typical screen analysis shown as follows:

| SUPERFINES | |
|---|---|
| Screen | Wt. % |
| On 100 | 14.5 |
| Through 100, on 150 | 8.83 |
| Through 150, on 200 | 16.08 |
| Through 200, On 325 | 21.5 |
| Through 325 | 39.09 |

Grades X-2, X-3, X-4 and X-5 of the TERRA-FIL products have average specific gravity at the higher end of the range specified above and are hence particularly useful in granular compositions of the present invention. TERRA-FIL Grade X-4, for example, is a highly preferred material of this type. This particular expanded perlite has an average specific gravity of about 1.7 and a typical screen analysis shown as follows:

| TERRA-FIL X-4 | |
|---|---|
| Screen | Wt. % |
| On 65 | 2.0 |
| Through 65, On 100 | 6.0 |
| Through 100, On 200 | 46.0 |
| Through 200, On 325 | 29.0 |
| Fines | 13.0 |

-continued

| TERRA-FIL X-4 | |
|---|---|
| Screen | Wt. % |
| Lost | 4.0 |

Expanded perlite abrasive is present within the instant compositions to the extent of from about 1% to 65% by weight. For liquid systems, abrasive concentration generally ranges from about 2% to 25% by weight, more preferably from about 3% to 15% by weight. For granular systems, abrasive concentration generally ranges from about 2% to 65% by weight, more preferably from about 10% to 40% by weight.

FILLER MATERIAL

The third essential component of the instant compositions is a filler material which can be an inorganic alkaline salt, water or mixtures of such salts and water, depending upon whether the composition is liquid or granular in nature.

Inorganic alkaline salts can perform several functions besides that of filler material. Such salts can, for example, serve as buffering agents or detergency builders.

Buffering Agents

It is preferred that the pH of the present composition and of aqueous cleaning solutions thereof be maintained within the alkaline range to provide optimum cleaning performance. When liquid or granular bleach-containing systems are prepared, it is highly preferred to maintain composition or use pH within the range of from about 10.5 to 12.5.

Any material or mixture of materials which has the effect of altering composition or composition solution pH to within the alkaline range (preferably from 10.5 to 12.5) and maintaining it there can be utilized as a preferred inorganic filler of the instant invention if said filler is to be a buffering agent. Such materials can include, for example, various water-soluble inorganic salts such as the carbonates, bicarbonates, sequiscarbonates, silicates, pyrophosphates, phosphates, orthoborates, tetraborates, and mixtures thereof, Examples of materials which can be used either alone or in combination as a buffering inorganic salt herein include sodium carbonate, sodium bicarbonate, sodium sesquicarbonate, sodium silicate, tetrapotassium pyrophosphate, trisodium phosphate, tripotassium phosphate, anhydrous sodium tetraborate, sodium tetraborate pentahydrate and sodium tetraborate decahydrate. Preferred filler salts useful as buffering agents herein include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1 and mixtures of anhydrous sodium carbonate and sodium metasilicate in a carbonate/metasilicate weight ratio of about 3:1.

As will be discussed hereinafter, it is highly preferred to include in the instant compositions a material which acts as a detergency builder, i.e., a material which reduces the free calcium and/or magnesium ion concentration in a surfactant-containing aqueous solution. Some of the abovedescribed buffering agents additionally serve as builder materials. Such compounds as the carbonates, phosphates and pyrophosphates are of this type. Other buffering agent components such as the silicates and tetraborates perform no building function.

Since presence of a detergency builder in the instant compositions is highly desirable, it is preferred that the buffering agent contain at least one compound capable of also acting as a builder.

Detergency Builder

The inorganic alkaline filler material can also beneficially function as a detergency builder in the present compositions. As noted above, many of the filler salts useful as buffering agents also act as builders, i.e. a material capable of lowering the free calcium and/or magnsium ion content of an aqueous solution containing such ions.

In addition to those dual buffer/builder compounds exemplified above, it is possible to add other inorganic builder compounds which either alone or in combination with other salts do not buffer within the preferred alkaline or highly preferred 10.5 to 12.5 pH range. Typical of these optional builder compounds which do not necessarily buffer within the preferred or highly preferred pH ranges are certain hexametaphosphates and polyphosphates. Specific examples of such materials include sodium tripolyphosphate, potassium tripolyphosphate and potassium hexametaphosphate.

Other Filler Salts

The inorganic filler salt can also be a material which functions neither as a buffer nor a detergency builder in the conventional sense. Such materials include, for example, sodium sulfate and sodium chloride.

Water

When liquid or semi-liquid compositions of the present invention are contemplated, the essential filler material comprises free water. As discussed more fully hereinafter, water is the medium in which abrasive and other materials are suspended or dispersed to form an abrasive, liquid composition. Water also serves to dissolve the soluble components of the instant invention such as the surfactant, filler salts, and optional materials. Since it is well known that transition metals can react with and deactivate some materials contemplated for use in the present invention (the bleaching agents, for example), "water" for purposes of the instant invention means "soft" or deionized water.

Some water can also be present in the granular compositions of the present invention. Water in granular compositions can be in either the form of water of hydration or in the form of free water absorbed by the granular components of the composition.

For purposes of this invention, the term "water" can refer both to free water used as a solvent in liquid systems and to water, either free or bound, present in granular systems. The term "moisture" for purposes of this invention refers only to that water, either free or bound, which is present in granular systems.

Mixtures of Water and Inorganic Salt

While the liquid compositions of the present invention must contain free water, such liquid compositions preferably also contains one or several of the inorganic buffering agents and/or detergency builders. Hence, a highly preferred filler component for the liquid compositions of the present invention is a mixture of water and inorganic salt.

While the granular compositions of the present invention must contain some inorganic salt or filler, such granular compositions almost inevitably will also contain some moisture. Hence, a highly preferred filler component for the granular compositions of the present invention is a mixture of moisture and inorganic salt.

Concentration of Filler Material

The filler component comprises the balance of the composition in addition to the essential surfactant and abrasive and in addition to whatever other optional materials are present.

For liquid compositions, the concentration of water preferably ranges from about 10% to 90% by weight, more preferably from about 50% to 90% by weight, and the concentration of the inorganic salt preferably ranges from about 1% to 15% by weight, more preferably from about 5% to 10% by weight.

For granular compositions, the concentration of moisture generally ranges from trace amounts up to about 30% by weight, and the concentration of inorganic salt preferably ranges from about 10% to 50% by weight, more preferably from about 15% to 40% by weight.

OPTIONAL MATERIALS

As noted above, in addition to the essential surfactant, abrasive and filler components, the present compositions can contain a wide variety of optional materials. These include the following:

Bleaching Agent

The instant compositions can optionally include a bleaching agent. Any suitable bleaching agent which yields active chloride or active oxygen in aqueous solution can be employed.

A highly preferred bleaching agent is one which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethylhydantion, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form. Some of the above materials are available as aqueous solutions.

If present, the above-described bleaching agents can generally comprise from about 0.1% to 10% by weight, more preferably from about 0.2% to 5% by weight, of the liquid compositions. Such bleaching agents generally comprise from about 0.2% to 30% by weight of granular compositions, more preferably from about 0.5% to 4% by weight.

Bleach Stabilizing Agents

For liquid compositions of the present invention which contain bleaching agent, bleaching agent stabilization is generally achieved by careful selection of bleaching agents and non-interfering surfactants and suspending-agents.

For granular systems containing bleach, it can be desirable to include a stabilizer for the bleaching agents. For some types of bleaching agents, particularly oxygen bleaching agents, this material can be a water-soluble bleach stabilizing agent selected from the group consisting of alkali metal, alkaline earth metal, ammonium and substituted ammonium salts of an acid having an ionization constant at 25° C, for the first hydrogen, of at least $1 \times 10^{-3}$. In general, the above-described stabilizing salts include some of the same materials which can be present as inorganic filler salts. Stabilizing salts include the alkali metal, alkaline earth metal, ammonium, and substituted ammonium sulfates, bisulfates, nitrates, phosphates, pyrophosphates, polyphosphates and hexametaphosphates. Specific examples of such materials include magnesium sulfate, sodium sulfate, potassium sulfate, ammonium sulfate, lithium sulfate, dimethylammonium sulfate, sodium bisulfate, potassium bisulfate, ammonium bisulfate, sodium nitrate, magnesium nitrate, calcium nitrate, sodium tripolyphosphate, trisodium phosphate, sodium metaphosphate, sodium hexametaphosphate, potassium pyrophosphate, and sodium tetraphosphate. Stabilizing agents of this type are described more fully in Nielsen; U.S. Pat. No. 3,639,285; issued Feb. 1, 1972, incorporated herein by reference.

For chlorine bleaching agents, particularly N-chloroimides, a highly preferred stabilizing agent is sodium acetate. Use of this material as a bleach stabilizer is described more fully in Abbott and Smith; U.S. Pat. No. 3,829,385; issued Aug. 13, 1974, incorporated herein by reference.

Bleach stabilizing agent is preferably used in granular compositions to the extent of from 0% to about 15% by weight of the composition.

Suspending Agent

For liquid compositions of the present invention, it is highly preferred to utilize an agent or material which suspends and disperses the perlite abrasive material throughout the liquid composition. Such materials can be any of those which form a thickened, plastic colloidal, paste-like, false-bodied or thixotropic composition when admixed with the free water present in liquid compositions herein. They include any of the inorganic or organic materials generally recognized in the art as thickening or suspending agents.

The most preferred suspending agents for use herein are the inorganic colloid-forming clays selected from the group consisting of smectites, attapulgites and mixtures of smectites and attapulgites. These clay materials combine with the free water of the liquid compositions of the present invention to form fluid compositions which are false-bodied in nature.

"False body" fluids are related to but are not identical to fluids having thixotropic properties. True thixotropic materials break down completely under the influence of high stresses and behave like true liquids even after the stress has been removed, until such time as the structure is reformed. False-bodied materials, on the other hand, do not, after stress removal, lose their solid properties entirely and can still exhibit a yield value even though it might be diminished. The original yield value is regained only after such fluids are at rest for considerable lengths of time (See Non Newtonian Fluids, Wilkinson, Permagon Press (1960)).

The instant preferred false-body compositions in a quiescent state are highly viscous, are Bingham plastic in nature, and have relatively high yield values. When subjected to shear stresses, however, such as being shaken in a bottle or squeezed through an orifice, these preferred compositions fluidize and can be easily dispensed. When the shear stress is stopped, the instant clay containing compositions quickly revert to a highly viscosity/Bingham plastic state.

The above-mentioned smectite clays which function in the instant compositions as colloid-forming agents (i.e., which form false-bodied fluids) can be described as expandable layered clays, i.e., aluminosilicates and magnesium silicates. The term "expandable" as used to describe the instant clays relates to the ability of the layered clay structure to be swollen, or expanded, on contact with water.

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectities are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atomic substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize chemical interaction between clay and optional composition components, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate smectite clays have a trioctahedral crystal lattice.

The smectite clays used in the compositions herein are all commercially available. Such clays include, for example, montmorillonite, volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from Georgia Kaolin Company, Elizabeth, New Jersey (both montmorillonites); Volclay BC and Volclay 325, from American Colloid Company, Skokie, Illinois; Black Hills Bentonite BH 450, from International Minerals and Chemicals; Veegum*, Veegum T, Veegum HS, Veegum Pro and Veegum F, from R. T. Vanderbilt (hectorites and montmorillonite); Barasym NAS-100, Barasym NAH-100, Barasym SMM 200, and Barasym LIH-300, all synthetic hectorites and saponites marketed by Baroid Division, NL, Industries, Inc.

Smectite clays are highly preferred for use in the instant invention. Montmorillonite, hectorite and saponite are the preferred smectites. Gelwhite GP, Gelwhite L, Barasym NAS-100, Barasym NAH-100, Veegum*, Veegum T, Veegum HS and Veegum F are the preferred montmorillonites, saponites and hectorites.

A second type of clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as: $(OH_2)_4(OH)_2Mg_5Si_8O_{20}.4H_2O$.

A typical attapulgite analysis yields 55.02% $SiO_2$; 10.24% $Al_2O_3$; 3.53% $Fe_2O_3$; 10.49% MgO; 0.47% $K_2O$; 9.73% $H_2O$ removed at 150° C; 10.13% $H_2O$ removed at higher temperatures.

Like the smectites, attapulgite clays are commercially available. For example, such clays are marketed under the tradename Attagel, i.e., Attagel 40, Attagel 50 and Attagel 150 from Engelhard Minerals & Chemicals Corporation.

Particularly preferred for the colloid-forming component in certain embodiments of the instant composition are mixtures of smectite and attapulgite clays. With higher abrasive levels, i.e., above 20% by weight, such a clay mixture provides compositions which have false body properties surprisingly more desirable than compositions prepared with either smectite or attapulgite alone. In general, such mixed clay compositions exhibit increased and prolonged fluidity upon application of shear stress but are still adequately thickened solutions at times when flow is not desired. Clay mixtures in a smectite/attapulgite weight ratio of from 4:1 to 1:5 are preferred. Ratios of from 2:1 to 1:2 are more preferred. A ratio of about 1:1 is most preferred.

As noted above, the clay employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example, a sodium clay is one in which the absorbed cation is predominately sodium. Such absorbed cations can become involved in exchange reactions with cations present in aqueous solutions.

Clay materials obtained under the forgoing commercial tradenames can comprise mixtures of the various discrete mineral entities. Such mixtures of the minerals are suitable for use in the present compositions. In addition, natural clays sometimes consist of particles in which unit layers of different types of clay minerals are stacked together (interstratification). Such clays are called mixed layer clays, and these materials are also suitable for use herein.

The colloid-forming clay materials useful in the instant invention are described more fully in H. van Olphen, "Clay Minerology", An *Introduction to Clay Colloid Chemistry,* Interscience Publishers, 1973; pp 54-73 and Ross and Hendricks, "Minerals of the Montmorillonite Group" *Professional Paper 205B of the United States Department of the Interior Geological Survey,* 1945; pp 23-79; both articles being incorporated herein by reference.

The suspending agent is generally present in the liquid compositions of the instant invention to the extent of from about 1% to 30% by weight, preferably from about 2% to 5% by weight, of the total composition.

Dedusting Materials

Since expanded perlite is a rather dusty material in the dry state, the dry granular abrasive scouring composition described herein tend to be somewhat dusty. This dustiness can be eliminated by spraying suitable dedusting agents onto the expanded perlite itself and/or spraying these agents onto the finished product. Suitable dedusting agents include mineral oil, saturated $C_{10}$ to $C_{30}$ aliphatic hydrocarbons such as dodecane, hexadecane, octadecane and docosane, and surfactants of the anionic, nonionic, ampholytic or zwitterionic type such as those described under the heading "SURFACTANT" hereinabove. Preferred surfactants for use as dedusting agents are the nonionic alkylene oxide condensates described hereinbefore. Particularly preferred are nonionic alkylene oxide condensates which are liquid at room temperature, examples being Tergitol 15-S-9 (an ethoxylated secondary alcohol having an average alkyl chain of about 15 carbon atoms and containing about 9 ethylene oxide groups) and nonyl phenyl condensed with about 9.5 moles of ethylene oxide. Surfactants which are solids at room temperature can be melted or made into a thin paste with water and sprayed onto the granules to be dedusted. Tergitol 15-S-9 is a particularly preferred dedusting agent.

The amount of dedusting agent used will generally be from about 0.01% to about 2%, preferably from about 0.05% to 1% and most preferably from about 0.05% to about 0.5% of the total composition. The dedusting agent can be sprayed onto the expanded perlite before the composition is prepared, it can be sprayed onto the entire composition after it is prepared, or part of the dedusting agent can be sprayed onto the perlite and the remainder sprayed onto the composition after it is prepared. A preferred method is to spray approximately 80% of the dedusting agent onto the perlite, mix the remaining dry ingredients with the perlite, then spray on the remainder of the dedusting agent, mixed with any other liquid ingredient (e.g., perfume) which is to be added.

Additional Abrasive Material

In addition to the essential expanded perlite abrasive material described above, both the liquid and granular compositions of the instant invention can contain some conventional abrasive material.

Conventional abrasive material is generally water-insoluble, has particle size ranging from 1 to 250 microns and has specific gravity ranging from 1.0 to 5.0.

These abrasives which can be optionally utilized include, but not limited to, quartz, pumice, pumicite, titanium dioxide ($TiO_2$), silica sand, calcium carbonate, calcium phosphate, zirconium silicate, diatomaceous earth, whiting, tripoli, melamine, urea formaldehyde and feldspar. Mixtures of different types of abrasive material can also be employed. Silica sand is the preferred abrasive for optional use in the instant compositions.

It is important that any optional conventional abrasive material present in the instant compositions be restricted to a relatively low level in order to preserve the especially desirable rinsability properties of the present invention. Preferably, therefore, conventional abrasive comprises from 0% to about 15% by weight of the composition, more preferably from 0% to 5% by weight of the composition.

Addition Builder Material

In addition to the above-identified inorganic filler salts which can function as detergency builders, it is possible to include in both the liquid and granular abrasive compositions of the instant invention organic materials which function as builders. Such materials can be, for example, any of the known polycarboxylate builders such as citrate, mellitate, oxydiacetate, nitrilotriacetate, or oxydisuccinate salts or any of the known organic phosphonate builders such as the salts of ethane hydroxy diphosphonic acids. Organic builders are generally employed in the absence of bleach.

Additional organic builder material comprises from 0% to about 20% by weight of the composition.

Miscellaneous Optional Materials

Both the liquid and granular compositions of the instant invention can contain miscellaneous optional adjuvant materials designed to improve the performance or aesthetics of the compositions. Optional materials which improve composition performance include such adjuvants as bleach catalysts which can be sulfamic acid, sulfamic acid derivatives and bromide salts. Other adjuvants include calcium oxide or hydroxide. Use of these performance-enhancing adjuvant materials in compositions of the instant type is discussed more fully in McClain and Meyer; U.S. Pat. No. 3,583,922; issued June 8, 1971 and Morgenstern; U.S. Pat. No. 3,715,314; issued Feb. 6, 1973; both patents being incorporated herein by reference.

Optional materials which improve composition aesthetics include conventional perfumes, dyes and coloring agents which are resistant to chemical interaction with other components of the present compositions.

If present, such miscellaneous optional materials generally comprise from 0% to about 10% by weight of the composition.

COMPOSITION PREPARATION

The abrasive cleanser compositions of the instant invention, both liquid and granular, can be prepared by admixing the above-described essential and optional components together in the appropriate concentrations in any order by any conventional means normally used to form the requisite compositions. Some shear agitation is, of course, necessary to insure proper preparation of the liquid compositions. The extent of shear agitation, in fact, can be used to vary as desired the nature of the liquid compositions so prepared.

In a particularly preferred procedure for preparing false-body liquid compositions, a certain order of addition of components and certain types of shear agitation can be employed to provide compositions having exceptionally desirable abrasive suspension and phase separation properties. In such a procedure, a false-body fluid phase is formed by admixing water, colloid-forming agent, dye, perfume and perhaps a small amount of builder under relatively high shear agitation. Surfactant and additional builder are then blended into the false-body phase. A separate aqueous slurry of bleach and abrasive is then prepared and added to the false body phase under moderate shear to provide a uniform and homogenous false body composition.

HARD SURFACE CLEANSING

The liquid and granular compositions of the present invention are used in conventional manner to cleanse hard surfaces. Effective amounts of the liquid composition of the instant invention can be applied directly to hard surfaces and used as is. Effective amounts of the granular composition of the instant invention are applied to hard surfaces as aqueous solutions consisting of from about 1% to about 50% by weight of the granular composition.

After application to the surface to be cleansed, the compositions or solutions thereof are wiped across the surface under pressure in conventional manner. This is accomplished by utilizing any known household cleaning substrate such as wiping cloths, sponges, mops, brushes, brooms and the like.

After the wiping of the hard surface being cleansed, the surface is rinsed in conventional manner with water to remove the remaining composition as well as soil and stain material loosened or dissolved in the scouring process.

The liquid and granular cleanser compositions of the instant invention are illustrated by the following examples:

EXAMPLE I

A false body, hard surface abrasive cleanser of the following composition is prepared:

| COMPONENT | Wt.% |
|---|---|
| Barasym NAS-100 (Sodium Saponite Clay) | 4.25% |
| Tetrapotassium Pyrophosphate | 6.0 % |
| Tripotassium Phosphate | 2.0 % |
| Sodium Hypochlorite Bleach | 0.9 % |
| Sodium Lauryl Alkyl Sulfate Surfactant | 0.25% |
| Expanded Perlite Abrasive (Average Particle Diameter = 50 microns Average Specific Gravity = 0.7) | 6.5 % |
| Dye and Perfume | 0.75% |
| Soft Water | Balance |
| | 100.00% |
| Composition pH = 11.5 | |

The above-described Example I composition is prepared by mixing some of the tetrapotassium pyrophosphate, and tripotassium phosphate, and sodium saponite clay, dye, perfume and deionized water using relatively high shear agitation to the extent necessary to form a false body fluid phase. A slurry containing the perlite abrasive, alkyl sulfate surfactant, additional builder, aqueous sodium hypochlorite, and deionized water is then prepared and slowly added to the false body phase while the false body phase is liquified under moderate shear agitation.

The resulting above-described Example I scouring composition is false bodied, i.e., gel-like in its quiescent state but easily fluidized by application of shear stress. In its quiescent state, the composition maintains the perlite abrasive in a uniformly suspended dispersion. When applied to horizontal or vertical hard surfaces, the composition is not fluid and does not appreciably run along such surfaces.

Such a composition exhibits negligible clear layer separation and negligible bleach and/or surfactant decomposition over a storage period of six weeks. Such a composition is effective for removal of stains and soil from hard surfaces and leaves very little or no abrasive residue or grit on such hard surfaces after the cleanser composition has been rinsed away.

Compositions of substantially similar physical, chemical and performance properties are realized when in the above-described Example I composition the Barasym NAS 100 colloid-forming clay is replaced with an equivalent amount of fooler clay, Thixogel 1, Gelwhite GP, Volclay BC, Volclay 325, Black Hills Bentonite BH 450, Veegum Pro, Veegum F, Barasym NAH-100, Barasym SMM-200, Barasym LIH-200, Attagel 50 or a mixture of Barasym NAS-100 smectite and Attagel 50 attapulgite in a smectite/attapulgite weight ratio of about 1:1.

Compositions of substantially similar chemical, physical and performance properties are realized when in the above-described Example I composition the pyrophosphate/phosphate buffering/builder system is replaced with an equivalent amount of a mixture of tetrapotassium pyrophosphate and trisodium phosphate in a pyrophosphate/phosphate weight ratio of about 3:1 (pH - 11.8); sodium carbonate (pH - 11.3); sodium metasilicate (pH - 12.8); trisodium phosphate (pH - 12.3); a mixture of anhydrous sodium carbonate and sodium metasilicate in a carbonate/metasilicate weight ratio of about 3:1 (pH - 11.8) or a mixture of tetrapotassium pyrophosphate and sodium carbonate in a pyrophosphate/carbonate weight ratio of 1.5:1 (pH - 11.0).

Compositions of substantially similar physical, chemical and performance properties are realized when in the Example I composition, the sodium hypochlorite bleaching agent is replaced with potassium hypochlorite, monobasic calcium hypochlorite, dibasic magnesium hypochlorite, chlorinated tri-sodium phosphate dodecahydrate, potassium dichloroisocyanurate, sodium dichloroisocyanurate, trichlorocyanuric acid, 1,3-dichloro-5,5-dimethylhydantoin, N-chlorosulfamide, Chloramine T, Dichloramine T, Chloramine B or Dichloramine B in amounts sufficient to provide an equivalent amount of available chlorine.

Compositions substantially similar chemical, physical and performance properties are realized when in the above-described Example I composition the sodium lauryl alkyl sulfate is replaced with an equivalent amount of sodium coconut alkyl sulfate, potassium coconut alkyl sulfate, potassium lauryl alkyl sulfate, or hexadecyl dimethylammonium hexanoate.

EXAMPLE II

A granular hard surface abrasive cleanser of the following composition is prepared:

| COMPONENT | Wt.% |
|---|---|
| Sodium Linear $C_{11.8}$—Alkyl Benzene Sulfonate | 5.33% |
| Expanded Perlite Abrasive (Johns-Manville TERRA-FIL X-4, Average Particle Diameter = 75 microns Average Specific Gravity = 1.7) | 25.1 % |
| Trisodium Phosphate | 20.54% |
| Sodium Tripolyphosphate | 25.30% |
| Sodium Hypochlorite | 1.6 % |

-continued

| COMPONENT | Wt.% |
|---|---|
| Sodium Sulfamate | 0.43% |
| Miscellaneous | 10.2 % |
| Moisture | 11.5 % |
| | 100.00% |
| Use pH = 11.8 | |

The Example II composition is effective for removal of stains and soil from hard surfaces, produces little filming and streaking of such surfaces and leaves very little abrasive residue or grit on such hard surfaces after the cleanser composition has been rinsed away.

Compositions of substantially similar physical, chemical and performance properties are realized when in the above-identified Example II composition the sodium hypochlorite bleaching agent is replaced with potassium hypochlorite, monobasic calcium hypochlorite or dibasic magnesium hypochlorite in amounts sufficient to provide an equivalent amount of available chlorine.

Compositions of substantially similar physical, chemical and performance properties are realized when in the above-described Example II composition part of the perlite abrasive is replaced with silica flour (average particle diameter = 55 microns; average specific gravity = 2.4) such that the silica concentration is about 10% by weight of the composition.

EXAMPLE III

A phosphate-free, granular hard surface abrasive cleanser of the following composition is prepared:

| COMPONENT | Wt. % |
|---|---|
| Sodium Linear $C_{11.8}$—Alkyl Benzene Sulfonate | 6.47% |
| Expanded Perlite Abrasive (Johns-Manville TERRA-FIL X-4, Average Particle Diameter = 75 microns, Average Specific Gravity = 1.7) | 33.45% |
| Alkali Metal Carbonates | 36.73% |
| Sodium Dichlorocyanurate Dihydrate | 3.44% |
| Sodium Sulfamate | 0.53% |
| Sodium Acetate | 14.7 % |
| Lime (Calcium Oxide) | 2.06% |
| Perfume | 0.5% |
| Moisture | 1.15% |
| Miscellaneous | 0.97% |
| | 100.00% |
| Use pH = 11.8 - 12.2 | |

EXAMPLE IV

A granular hard surface abrasive cleanser having the following composition is prepared:

| COMPONENT | Wt. % |
|---|---|
| Expanded Perlite Abrasive (Johns-Manville Abrasive TERRA-FIL X-4, Avg. Particle Diameter = 75 microns) | 32.80 |
| Tergitol 15-S-9 | 0.50 |
| Chlorinated Trisodium Phosphate (Av. $Cl_2$ 3.2%) | 42.00 |
| Sodium tripolyphosphate | 3.30 |
| Orvus AB Granules (40% linear alkylbenzene sulfonate) | 11.00 |
| Sodium Sulfate | 10.00 |
| Perfume | 0.40 |
| | 100.00 |

Approximately 80% of the Tergitol is sprayed onto the perlite in a cement mixer. The dedusted perlite is then mixed with the remainder of the dry ingredients, then the remaining 20% of the Tergitol is mixed with the prefume and sprayed onto this dry mixture. The resulting product is a dry nondusty, free-flowing granular hard surface abrasive product.

The Example III composition is effective for removal of stains and soil from hard surfaces, produces little filming and streaking of such surfaces and leaves very little abrasive residue or grit on such hard surfaces after the cleanser composition has been rinsed away.

Compositions of substantially similar physical, chemical and performance properties are realized when in the above-described Example III composition the sodium dichlorocyanurate dihydrate bleaching agent is replaced with potassium dichloroisocyanurate, trichlorocyanuric acid, 1,3-dichloro-4,4-dimethylhydantoin, N-chlorosulfamide, Chloramine T, Dichloramine T, Chloramine B or Dichloramine B in concentrations sufficient to provide an equivalent amount of available chlorine.

STAIN AND SOIL REMOVAL TESTING

The ability of the instant composition, both liquid and granular, to remove stains and soil from hard surfaces is determined by tests involving removal of test stains and soil from conventional porcelain hard surfaces. The test stain employed is a manganese dioxide stain. The test soil utilized is a synthetically prepared bathtub soil (BTS).

Porcelain test tiles stained with manganese dioxide are prepared by contacting the panel with a 1% manganese chloride solution followed by flushing with a commercially-available hypochlorite bleaching agent, CLOROX. The resulting stain is dark brown.

Porcelain test tiles are treated with synthetically-prepared bathtub soil (BTS) by brushing the soil paste on the test tile and heating the tile at 130° C for 5–10 minutes and repeating this procedure several times. The BTS soil is itself prepared by forming curd from simulated natural skin oil and soap in water of about 21 grains/gal. hardness.

Test tiles are washed using a control solution and solutions of product to be tested. Washing is accomplished by utilizing a modified Gardner Model M-105-A Washability Machine, a device for mechanically passing a sponge across a flat surface in a uniform and reproducible manner.

The control solution is prepared by forming a 50% aqueous slurry from 500 grams of a commercially available scouring cleanser, COMET. Five cubic centimeters of this control solution is placed on the Gardner Machine sponge.

The two test solutions are prepared from the compositions of Examples I and II. Three grams of the liquid composition of Example I and 5 cc. of a 50% aqueous slurry of the Example II composition are used on the Gardner Machine sponge.

The same number of strokes with each test solution is utilized. After cleaning, the test tiles are allowed to dry and are visually graded by a panel of human graders. Tiles are graded on a scale of from <4 to +4 with −4 indicating much poorer performance than the control, 0 indicating about the same performance as the control and +4 indicating much better performance than the control. Results of the stain and soil removal testing appear in TABLES I and II.

TABLE I

| Manganese Dioxide Stain Removal | |
|---|---|
| COMPOSITION | PANEL GRADE |
| COMET Control | PAR |
| Example I Composition | −1 |
| Example II Composition (Replicate 1) | +3 |
| Example II Composition (Replicate 2) | +3 |
| Example II Composition (Replicate 3) | +2 |

TABLE II

| Bathtub Soil (BTS) Removal | |
|---|---|
| COMPOSITION | Panel Grade |
| COMET Control | Par |
| Example I Composition | +3 |
| Example II Composition (Replicate 1) | +3 |
| Example II Composition (Replicate 2) | +2 |

The above stain and soil removal data demonstrate that both the liquid and granular compositions of the present invention utilizing an expanded perlite abrasive compares very favorably with a typical commercially-available, scouring cleaner containing silica as the abrasive material.

RESIDUAL GRIT TESTING

The rinsability of the abrasive in the instant composition, both liquid and granular, is evaluated by means of a residual grit test. In that test, slurries of both plates of black porcelain. These plates are then tilted to an angle of about 3° to 5° from horizontal and rinsed with a gentle stream of water from a ¼ inch rubber hose, said rinsing simulating the flow of water from a draining bathtub. The produce slurries are formed from ½ gram control and test compositions mixed with 3 milliliters of city water at room temperature. The control composition is a commercially-available silica abrasive containing scouring cleanser, COMET; the test compositions are the compositions of examples I and II above. Rinsing occurs for five seconds.

The test plates are visually graded by a panel of human graders. Plates are graded on a scale of from −4 to +4 with −4 indicating abrasive rinsability much poorer than the control, 0 indicating rinsability about the same as the control and +4 indicating rinsability much better than the control. Results of the residual grit testing appear in TABLE III.

TABLE III

| Residual Grit Testing | |
|---|---|
| COMPOSITION | PANEL GRADE |
| COMET Control | Par |
| Example I Composition | +1 |
| Example II Composition | +3 |

These data indicate that the compositions of the present invention containing perlite abrasive material provide superior rinsability and leave less residual abrasive grit on surfaces cleansed than does a typical conventional commercially-available silica abrasive-containing cleanser.

What is claimed is:

1. A liquid, abrasive, hard surface cleansing composition which leaves little or no abrasive residue on hard surfaces after use, said composition consisting essentially of:

a. from about 0.1% to 7% by weight of a surfactant selected from the group consisting of water soluble alkyl sulfates containing from about 8 to about 18 carbon atoms in the alkyl group;

b. from about 2% to 25% by weight of a particulate expanded perlite abrasive material, substantially all of said material ranging in particle size from 1 micron to 190 microns, said material having an average specific gravity ranging from about 0.2 to 2.2;

c. from about 0.1% to 10% by weight of a bleaching agent which yields hypochlorite species in aqueous solution;

d. from about 1% to 30% by weight of a suspending agent which serves to maintain said expanded perlite abrasive material dispersed throughout said liquid composition wherein said suspending agent is an inorganic colloid-forming clay selected from the group consisting of smectites, attapulgites and mixtures thereof; and e. the balance of said liquid composition consisting essentially of a filler selected from the group consisting of water and mixtures of water and inorganic salts, the concentration of water ranging from about 10% to 90% by weight of the composition.

2. The composition of claim 1 wherein the suspending agent serves to form a false-body fluid upon admixture with the water component of the said filler.

3. A composition in accordance with claim 2 wherein the expanded perlite abrasive has an average specific gravity of from about 0.5 to 0.99 and is present to the extent of from about 3% to 15% by weight of the composition.

4. A composition in accordance with claim 3 wherein the filler component contains an inorganic salt or salt mixture which acts as a buffering agent capable of maintaining composition pH within the alkaline range, the concentration of said inorganic salt or salt mixture ranging from about 1% to about 15% by weight of the composition.

5. A composition in accordance with claim 4 wherein the inorganic salt or salt mixture is capable of maintaining composition pH within the range of from 10.5 to 12.5 and is further capable of acting as a detergency builder which serves to reduce the free calcium and/or magnesium ion content of an aqueous solution.

6. A composition in accordance with claim 5 wherein a. the surfactant is a water-soluble alkyl sulfate containing from about 8 to 18 carbon atoms in the alkyl group;

b. substantially all of the particulate expanded perlite abrasive material ranges in particle size from about 20 microns to 110 microns;

c. the inorganic salt component of the filler is water-soluble and is selected from the group consisting of carbonates, bicarbonates, sesquicarbonates, silicates, pyrophosphates, phosphates, tetraborates, and mixtures thereof;

d. the bleaching agent is selected from the group consisting of alkali metal hypochlorites, alkaline earth metal hypochlorites, hypochlorite addition products, chloramines, chlorimines, chloramides, and chlorimides and is present to the extent of from about 0.2% to 5% by weight of the composition;

e. the suspending agent is a smectite clay selected from the group consisting of montmorillonites, volchonskoites, nontronites, beidellites, hectorites, saponites, sauconites and vermiculites.

7. A composition in accordance with claim 6 wherein a. the surfactant is selected from the group consisting of sodium coconut alkyl sulfate, potassium coconut alkyl sulfate, potassium lauryl alkyl sulfate and sodium lauryl alkyl sulfate;

b. the inorganic salt component of the filler is selected from the group consisting of sodium carbonate, sodium metasilicate, trisodium phosphate, tripotassium phosphate, a mixture of tetrapotassium pyrophosphate and tripotassium phosphate in a pyrophosphate/phosphate weight ratio of about 3:1, a mixture of tetrapotassium pyrophosphate and trisodium phosphate in a pyrophosphate/phosphate weight ratio of about 3:1, a mixture of anhydrous sodium carbonate and sodium metasilicate in a carbonate/metasilicate weight ratio of 3:1 and a mixture of tetrapotassium pyrophosphate and potassium carbonate in a pyrophosphate/carbonate weight ratio of about 3:1;

c. the bleaching agent is selected from the group consisting of sodium hypochlorite, potassium hypochlorite, monobasic calcium hypochlorite and dibasic magnesium hypochlorite; and d. suspending agent is selected from the group consisting of montmorillonites, hectorites and saponites.

8. A composition in accordance with claim 7 wherein a. the surfactant is sodium lauryl alkyl sulfate;

b. the particulate expanded perlite abrasive material has an average particle size of about 50 microns and an average specific gravity of about 0.7:

c. the inorganic salt component of the filler is a mixture of tetrapotassium pyrophosphate and tripotassium phosphate in a pyrophosphate/phosphate weight ratio of about 3:1; and d. the bleaching agent is sodium hypochlorite.

* * * * *

UNITED STATES PATENT AND TRADEMARK OFFICE

CERTIFICATE OF CORRECTION

PATENT NO. : 4,051,056

DATED : September 27, 1977

INVENTOR(S) : William Law Hartman

It is certified that error appears in the above-identified patent and that said Letters Patent are hereby corrected as shown below:

Column 1, line 12, "cleaners" should be -- cleansers --.

Column 3, line 49, after "be" and before "of" insert -- any --.

Column 4, line 35, "Hass" should be -- Haas --.

Column 6, line 12, "bentaines" should be -- betaines --.

Column 10, line 61, "contains" should be -- contain --.

Column 18, line 68, "25.30%" should be -- 15.30% --.

Column 19, line 5, "11.5%" should be -- 21.5% --.

Column 21, line 28, after "both" and before "plates" insert

-- control and test products are distributed evenly on test --.

UNITED STATES PATENT AND TRADEMARK OFFICE

CERTIFICATE OF CORRECTION

PATENT NO. : 4,051,056

DATED : September 27, 1977

INVENTOR(S) : William Law Hartman

It is certified that error appears in the above-identified patent and that said Letters Patent are hereby corrected as shown below:

Column 21, line 33, "produce" should be -- product --.

Column 21, line 34, before "control" insert -- of --.

Column 20, line 63, "<" should be -- - --.

Signed and Sealed this

Ninth Day of May 1978

[SEAL]

Attest:

RUTH C. MASON
Attesting Officer

LUTRELLE F. PARKER
Acting Commissioner of Patents and Trademarks